US007084826B2

(12) United States Patent
Aisenbrey

(10) Patent No.: US 7,084,826 B2
(45) Date of Patent: Aug. 1, 2006

(54) LOW COST INDUCTOR DEVICES MANUFACTURED FROM CONDUCTIVE LOADED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 10/825,979

(22) Filed: Apr. 16, 2004

(65) Prior Publication Data

US 2004/0196201 A1 Oct. 7, 2004

Related U.S. Application Data

(63) Continuation-in-part of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/484,457, filed on Jul. 2, 2003, provisional application No. 60/463,367, filed on Apr. 16, 2003, provisional application No. 60/269,414, filed on Feb. 16, 2001, provisional application No. 60/268,822, filed on Feb. 15, 2001.

(51) Int. Cl.
*H01Q 1/00* (2006.01)

(52) U.S. Cl. ..... 343/788; 343/787; 343/867; 343/742

(58) Field of Classification Search ..... 343/787–788, 343/867, 742; 264/427, 104, 184, 105, 205, 264/187, 211, 210.6; 524/495
See application file for complete search history.

(56) References Cited

U.S. PATENT DOCUMENTS

| | | | | |
|---|---|---|---|---|
| 3,958,066 | A * | 5/1976 | Imamura et al. | 428/372 |
| 4,345,208 | A | 8/1982 | Wilson | 324/329 |
| 4,743,505 | A * | 5/1988 | Yamada et al. | 428/373 |
| 4,747,992 | A * | 5/1988 | Sypula et al. | 264/130 |
| 4,862,316 | A | 8/1989 | Smith et al. | 361/220 |
| 4,904,863 | A * | 2/1990 | McDearmon | 250/227.17 |
| 5,247,297 | A | 9/1993 | Seabury et al. | 340/941 |
| 5,652,577 | A | 7/1997 | Frasier | 340/933 |

(Continued)

FOREIGN PATENT DOCUMENTS

GB 2377449 A 1/2003

*Primary Examiner*—Hoang V. Nguyen
*Assistant Examiner*—Chuc Tran
(74) *Attorney, Agent, or Firm*—Douglas R. Schnabel

(57) ABSTRACT

Inductors and inductive devices are formed of a conductive loaded resin-based material. The conductive loaded resin-based material comprises micron conductive powder(s), conductive fiber(s), or a combination of conductive powder and conductive fibers in a base resin host. The ratio of the weight of the conductive powder(s), conductive fiber(s), or a combination of conductive powder and conductive fibers to the weight of the base resin host is between about 0.20 and 0.40. The micron conductive powders are formed from non-metals, such as carbon, graphite, that may also be metallic plated, or the like, or from metals such as stainless steel, nickel, copper, silver, that may also be metallic plated, or the like, or from a combination of non-metal, plated, or in combination with, metal powders. The micron conductor fibers preferably are of nickel plated carbon fiber, stainless steel fiber, copper fiber, silver fiber, or the like.

55 Claims, 7 Drawing Sheets

U.S. PATENT DOCUMENTS 5,652,649 A * 7/1997 Ikegawa et al. ..... 399/175
5,744,090 A * 4/1998 Jones et al. ..... 264/427
5,759,462 A * 6/1998 Jordan ..... 264/105
5,808,562 A 9/1998 Bailleul et al. ..... 340/933
5,843,567 A * 12/1998 Swift et al. ..... 428/221
5,969,528 A 10/1999 Weaver ..... 324/329
6,127,474 A * 10/2000 Andelman ..... 524/495
6,582,887 B1 * 6/2003 Luch ..... 430/311
2001/0035297 A1 11/2001 Tamai ..... 174/133 R

* cited by examiner

LOW COST INDUCTOR DEVICES MANUFACTURED FROM CONDUCTIVE LOADED RESIN-BASED MATERIALS

This Patent Application claims priority to the U.S. Provisional Patent Application 60/463,367 filed on Apr. 16, 2003, and to the U.S. Provisional Patent Application 60/484,457, filed on Jul. 2, 2003, which are herein incorporated by reference in their entirety.

This Patent Application is a Continuation-in-Part of INT01-002 CIP, filed as U.S. patent application Ser. No. 10/309,429, filed on Dec. 4, 2002, U.S. Pat. No. 6,870,516 also incorporated by reference in its entirety, which is a Continuation-in-Part application of docket number INT01-002, filed as U.S. patent application Ser. No. 10/075,778, filed on Feb. 14, 2002, U.S. Pat. No. 6,741,221 which claimed priority to U.S. Provisional Patent Applications Ser. No. 60/317,808, filed on Sep. 7, 2001, Ser. No. 60/269,414, filed on Feb. 16, 2001, and Ser. No. 60/268,822, filed on Feb. 15, 2001.

BACKGROUND OF THE INVENTION (1) Field of the Invention

This invention relates to inductor devices and, more particularly, to inductor devices molded of conductive loaded resin-based materials comprising micron conductive powders, micron conductive fibers, or a combination thereof, homogenized within a base resin when molded. This manufacturing process yields a conductive part or material usable within the EMF or electronic spectrum(s).

(2) Description of the Prior Art

Inductors and inductive devices are widely used in the fields of communication, radio transmission and reception, power conversion, magnetism, metal detection, and the like. All conductors exhibit some value of an inductance. Inductance is a measure of the ability of a conductor to generate electromotive force (EMF) due to a change in current. Current moving in a conductor generates a magnetic field surrounding the conductor. If the current in the conductor changes, then the magnetic field generated by that current also changes. This changing magnetic field further creates a relative motion between the magnetic field and the conductor. This relative motion further creates an induced (EMF) that is in a direction that will oppose the very current change that causes it. This is called a counter EMF. The basic unit of measure for inductance is the Henry (H) where an inductor has a value of 1 H if an EMF of 1 Volt is induced in that inductor when the current flowing through the inductor changes at a rate of 1 Ampere per second.

It is well known that if a conductor is shaped into a loop, then the electromagnetic field of any part of the loop will cut across, or be coupled to, some other part of the loop. As a result, the effective inductance of the conductor is increased by looping, or coiling, the conductor. Further, it is known that the number of turns of such a coil determines the relative inductance of this coupling. Further yet, the introduction of a core material inside of an inductor coil is known to alter the relative inductance of the conductor and, more particularly, the inductance can be increased by increasing the permeability of this coil. Coils of significant value are created by using any or all of these known factors of the core and/or the number of turns of the conductor around the core. Typical coils in the art are constructed of metal wire, such as copper, wound around core material, such as iron. In electrical systems, this inductance is used for applications such as the temporary storage of electrical energy, the creation of an inductor-capacitor network to thereby generate a resonance frequency response, and/or the transformation or isolation of voltage signals. A particularly important object of the present invention is to create inductors and/or inductive devices with improved features and from alternative materials.

Several prior art inventions relate to inductors, inductive loops, and inductive-based detectors. U.S. Pat. No. 5,247,297 to Seabury et al describes a method to detect motor vehicles crossing a loop inductor. U.S. Pat. No. 5,808,562 to Bailleul et al discloses a vehicle detector for roadway installation. The detector comprises a coaxial detector cable that further comprises a metallic central conductor, a metallic cladding, and a filler material therebetween. U.S. Pat. to No. 5,652,577 to Frasier describes an inductive loop sensing apparatus for controlling a traffic light. U.S. Pat. No. 5,969,528 to Weaver, U.S. Pat. No. 4,345,208 to Wilson, and U.S. Pat. No. 4,862,316 to Smith et al teach a portable metal detector device with transmitting and receiving coils of metal wire. U.S. Patent Application 2001/0035297 to Tamai teaches an electric wire or flat cable where the core wire or conductor comprises a highly conductive resin. The highly conductive resin may comprise a metal fiber in a thermoplastic resin. Alternatively, the highly conductive resin may comprise a lead-free solder or a copper powder dispersed in a thermoplastic resin.

SUMMARY OF THE INVENTION

A principal object of the present invention is to provide an effective inductor device.

A further object of the present invention is to provide a method to form an inductor device.

A further object of the present invention is to provide an inductor device molded of conductive loaded resin-based materials.

A yet further object of the present invention is to provide methods to fabricate an inductor device from a conductive loaded resin-based material incorporating various forms of the material.

A yet further object of the present invention is to provide an improved inductor device by improving the characteristics of the core material.

A yet further object of the present invention is to provide an improved inductor device by improving the characteristics of the wiring material.

In accordance with the objects of this invention, an inductor device is achieved. The inductor device comprises a loop of conductive loaded, resin-based material comprising conductive materials in a base resin host.

Also in accordance with the objects of this invention, an inductor device comprises a conductive loop and a core structure located inside the loop. The core structure comprises conductive loaded, resin-based material comprising conductive materials in a base resin host.

Also in accordance with the objects of this invention, a method to form an inductor device is achieved. The method comprises providing a conductive loaded, resin-based material comprising conductive materials in a resin-based host and molding the conductive loaded, resin-based material into an inductor device.

BRIEF DESCRIPTION OF THE DRAWINGS

In the accompanying drawings forming a material part of this description, there is shown.

DESCRIPTION OF THE PREFERRED EMBODIMENTS

Figure 1A:
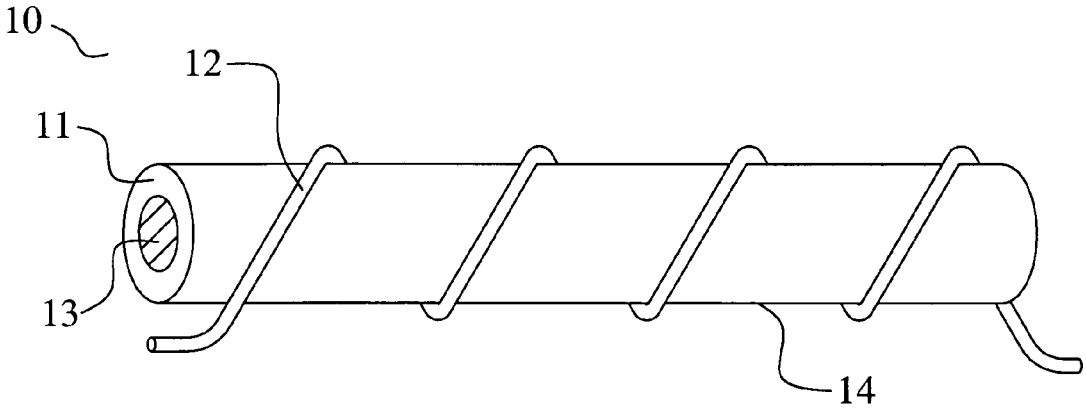
FIG. 1*a* illustrates a first preferred embodiment of the present invention showing an inductor wherein the conductor comprises a conductive loaded resin-based material.

This invention relates to inductors and inductive devices molded of conductive loaded resin-based materials comprising micron conductive powders, micron conductive fibers, or a combination thereof, homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are homogenized within the resin during the molding process, providing the electrical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of inductors and inductive devices fabricated using conductive loaded resin-based materials depend on the composition of the conductive loaded resin-based materials, of which the loading or doping parameters can be adjusted, to aid in achieving the desired structural, electrical or other physical characteristics of the material. The selected materials used to fabricate the inductors and inductive devices are homogenized together using molding techniques and or methods such as injection molding, over-molding, thermo-set, protrusion, extrusion or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

The use of conductive loaded resin-based materials in the fabrication of inductors and inductive devices significantly lowers the cost of materials and the design and manufacturing processes used to hold ease of close tolerances, by forming these materials into desired shapes and sizes. The inductors and inductive devices can be manufactured into infinite shapes and sizes using conventional forming methods such as injection molding, over-molding, or extrusion or the like. The conductive loaded resin-based materials, when molded, typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or in any combination thereof, which are homogenized together within the base resin, during the molding process, yielding an easy to produce low cost, electrically conductive, close tolerance manufactured part or circuit. The micron conductive powders can be of carbons, graphites, amines or the like, and/or of metal powders such as nickel, copper, silver, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. The micron conductive fibers can be nickel plated carbon fiber, stainless steel fiber, copper fiber, silver fiber, or the like, or combinations thereof. The structural material is a material such as any polymer resin. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion to create desired shapes and sizes. The molded conductive loaded resin-based materials can also be stamped, cut or milled as desired to form create the desired shape form factor(s) of the heat sinks. The doping composition and directionality associated with the micron conductors within the loaded base resins can affect the electrical and structural characteristics of the inductors and inductive devices and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming inductors and inductive devices that could be embedded in a person's clothing as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a corrosion and/or metal electrolysis resistant conductive loaded resin-based material is achieved. Another additional and important feature of the present invention is that the conductive loaded resin-based material of the present invention may be made flame retardant. Selection of a flame-retardant (FR) base resin material allows the resulting product to exhibit flame retardant capability. This is especially important in inductor and inductive device applications as described herein.

The homogeneous mixing of micron conductive fiber and/or micron conductive powder and base resin described in the present invention may also be described as doping. That is, the homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the homogeneous mixing of micron conductive fiber and/or micron conductive powder into a base resin.

As an additional and important feature of the present invention, the molded conductor loaded resin-based material exhibits excellent thermal dissipation characteristics. Therefore, inductors and inductive devices manufactured from the molded conductor loaded resin-based material can provide added thermal dissipation capabilities to the application. For example, heat can be dissipated from electrical devices physically and/or electrically connected to an inductor or inductive device of the present invention.

Referring now to FIG. 1*a,* a first preferred embodiment of the present invention is illustrated. Several important features of the present invention are shown and are discussed below. The present invention concerns the formation of inductors from conductive loaded resin-based material according to the present invention. The first preferred embodiment 10 of the present invention comprises forming a conductor 12 for an inductor 10 from conductive loaded resin-based material. The coiling 12 of the conductive loaded resin-based conductor creates significant cross coupling that increases the inductance value of the device 10.

In the illustration, the conductive loaded resin-based conductor 12 is formed around a core 14. A core material is not essential to the present invention. However, if used, a core 14 can increase the inductor value and/or provide electrical isolation and/or mechanical stability to the inductor 10. The core material 14 may comprise any of several materials. For example, the core 14 may simply comprise an insulating material of relatively low permeability. In this case, the core 14 may simply provide mechanical stability and electrical isolation. For example, a resin-based material may be first molded to form a core 14. Then the conductor 12 of conductive loaded resin-based material is over-molded onto the core 14. In this case, the core 14 may be hollow (air core) or may be solid. Alternatively, if the conductive loaded resin-based material is first formed into a fabric-like material, then this material 12 may be wound onto the core 14.

Alternatively, a conductive core 13 may be used. As is discussed above, the permeability of the core material will determine how much the core affects the inductance. For example, iron is well known as a core material with a high permeability. In the preferred embodiment shown, the core comprises a metal inner layer 13 with a surrounding insulating layer 11. In this arrangement, the insulating layer 11 may be applied to a previously formed metal core 13. Then the coil conductor 12 of conductive loaded resin-based material is over-molded onto the core 14. The resulting inductor 10 exhibits a higher inductance value due to the presence of the metal core 13.

The conductive loaded resin-based coil 12 may be used to form an inductor 10 of high inductance. In addition, by selecting the conductive material doping level of the conductive loaded resin-based material 12, the resistance of the inductor 10 can be carefully controlled. For example, by selecting a higher ratio of conductive material to base resin, a low resistivity conductive loaded resin-based material 12 is formed. Alternatively, by using a lower ratio of conductive material to base resin, a high resistivity conductive loaded resin-based material 12 is formed. In this way, the parasitic resistance of the inductor 10 can be carefully designed.

The first preferred embodiment provides an inductor that can be easily formed by molding operations such as injection molding or extrusion. Further, this inductor may be molded into a larger electrical system or structure. In particular, the conductive loaded resin-based material may be molded to form circuit conductors to supply electrical connections and to form inductive conductors 12 to provide inductive loads in the same electrical device. As a result, an integrated inductor is formed that can reduce part count, tooling costs, and assembly complexity in the final product. The novel inductor 10 may be very resistant to corrosion and/or electrolysis due to the excellent properties of the conductive loaded resin-based material. Therefore, the inductor 10 does not require a water/chemical shielding layer over the conductor 12 as is required for prior art, metal wire inductors.

Figure 1B:
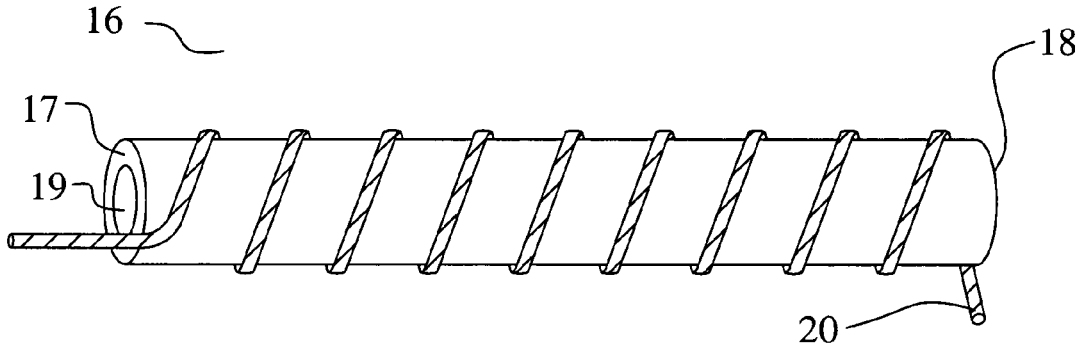
FIG. 1*b* illustrates a second preferred embodiment of the present invention showing an inductor wherein the inductor core comprises a conductive loaded resin-based material.

Referring now to FIG. 1*b,* a second preferred embodiment of the present invention is illustrated 16. Another inductor 16 is illustrated. In this case, the core 18 comprises the conductive loaded resin-based material 19 with an insulating layer overlying 17. A metal wire 20 is formed around the core 18 as the conductor. Alternatively, the conductor 20 may comprise conductive loaded resin-based material as in the first embodiment. In the second embodiment, the excellent permeability of the conductive loaded resin-based material is featured. In particular, a molded conductive loaded resin-based core 19 can easily be made if a conductive loading material with a high permeability is chosen. For example, conductive loading materials with a high iron content are particularly useful in forming a high permeability core 19. In the preferred embodiment, the core comprises a conductive loaded resin based center 19 surrounded by an insulating layer 17. More preferably, the center core 19 is first molded of conductive loaded resin-based material using injection molding or extrusion, and then the insulating layer 17 is over-molded, coated, or extruded over the center core 19. Finally, a metal wire conductor 20 is wound around the core 18 to complete the inductor 16. Alternatively, the conductor 20 may comprise yet more conductive loaded resin-based material that is over-molded onto the core 18.

The second preferred embodiment inductor device allows a large inductance value to be generated through the use the high permeability core material 19. The moldability of the conductive loaded resin-based material of the core 19 allows for more flexible manufacturing methods and for integration of the inductor into a conductive loaded resin-based circuit design as in the first embodiment. In addition, the conductive loaded resin-based core will exhibit corrosion and/or electrolysis resistance. Further, by adjusting the doping level and/or of the type of conductive material in the conductive loaded resin-based material, the permeability and the resistivity of the core 19 can be easily optimized.

Figure 1C:
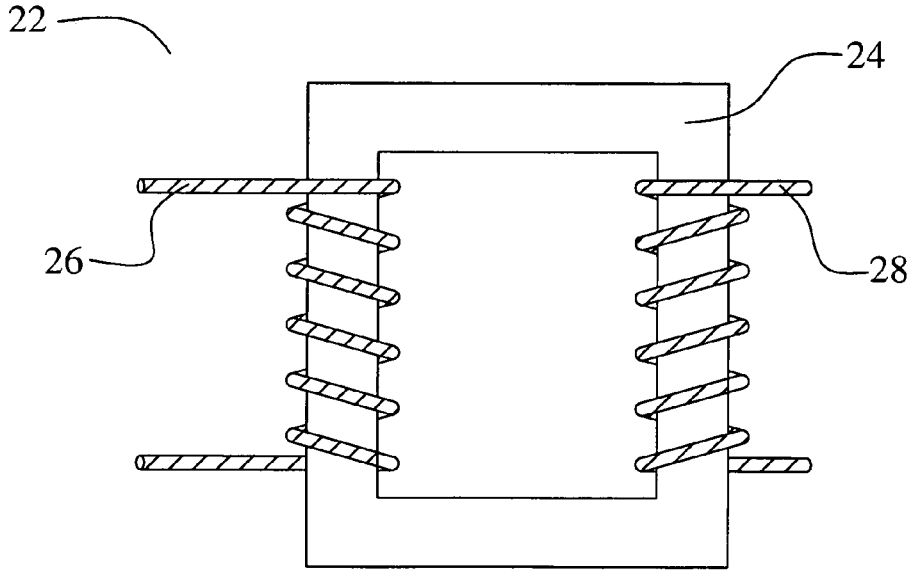
FIG. 1*c* illustrates a third preferred embodiment of the present invention showing a transformer wherein the inductor core comprises a conductive loaded resin-based material.

Referring now to FIG. 1*c,* a third preferred embodiment of the present invention is illustrated. A transformer device 22 is illustrated. The transformer device 22 comprises a core 24 with a first conductor winding 26 and a second conductor winding 28. The core 24 comprises the conductive loaded resin-based material according to the present invention. The first conductor winding 26 is inductively coupled to the second conductor winding 28 by mutual inductance through the core 24. The excellent permeability of the conductive loaded resin-based material 24 is again utilized in this embodiment. In particular, a molded conductive loaded resin-based core 24 can easily be made if a conductive loading material with a high permeability is chosen. For example, conductive loading materials with a high iron content are particularly useful in forming the high permeability core 24. As a particular example, an austinetic stainless steel fiber or powder is particularly useful since this type of stainless steel alloy has a relatively high iron content. In addition, the permeability of the base resin material is an important consideration. Preferably, a base resin material of relatively high permeability is used for the core.

In the preferred embodiment, the core may again comprise a conductive loaded resin based center surrounded by an insulating layer. More preferably, the center core is first molded of conductive loaded resin-based material using injection molding or extrusion, and then an insulating layer is over-molded, coated, or extruded over the center core 24. Finally, metal wire conductors 26 and 28 are wound around the core 24 to complete the transformed 22. Alternatively, the conductors 26 and 28 may comprise yet more conductive loaded resin-based material that is over-molded onto the core 24.

Figure 7A:
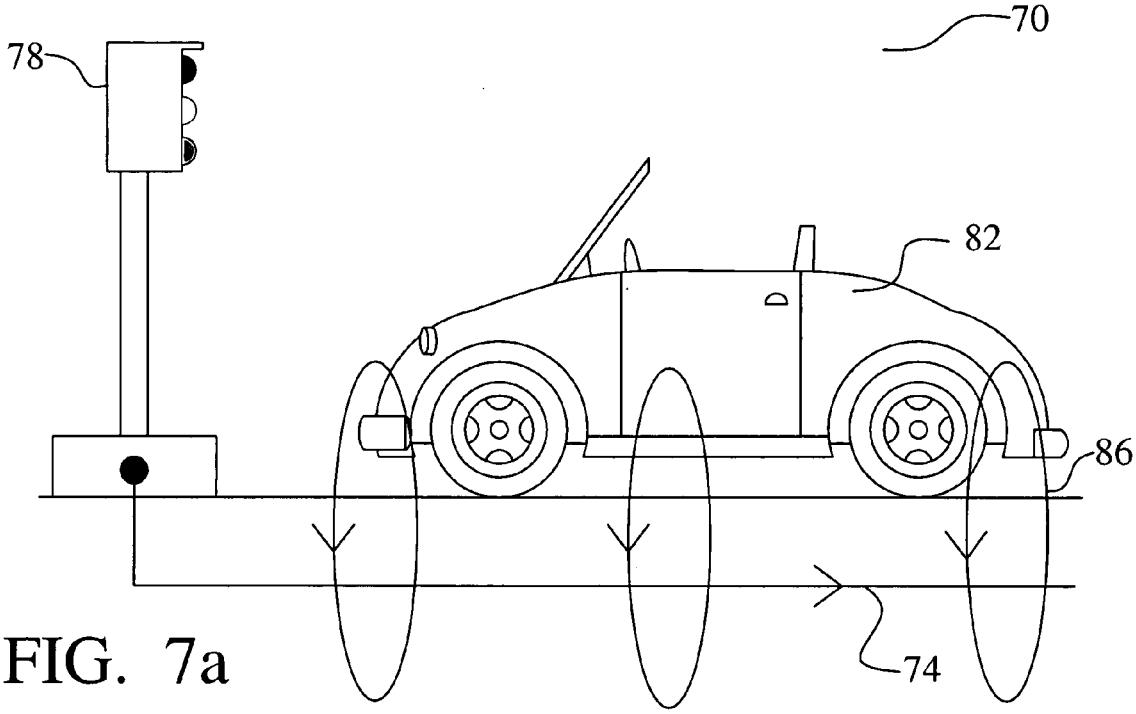
FIGS. 7*a* through 7*e* illustrate a fourth preferred embodiment of the present invention illustrating an inductive loop detector for sensing vehicles and for controlling a traffic light.
Figure 7B:
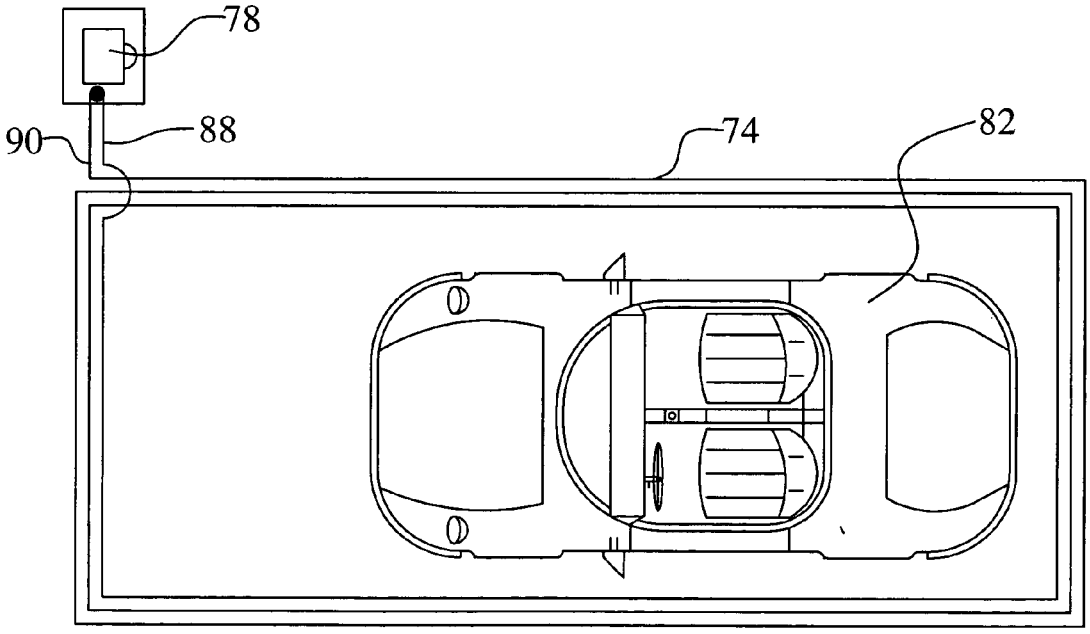

Referring now to FIGS. 7*a* through 7*e,* a fourth preferred embodiment of the present invention is illustrated. In this case, an inductive loop detector 70 is illustrated. Referring particularly to FIGS. 7*a* and 7*b,* in an inductive loop detector, a large inductive loop 74 is formed. The inductance value of the loop 74 may be quite small. However, this value will change if an object of substantial permeability enters the loop cross section, or core. In the illustrated embodiment, the loop 74 comprises a conductor of conductive loaded resin-based material according to the present invention. Several turns, or winds, of the conductor are made around the perimeter of the loop 74. In the illustration, three winds of the conductive loaded resin-based conductor are made around a perimeter large enough to contain a motor vehicle 82. When the motor vehicle 82 enters the perimeter of the loop 74, the vehicle 82 acts as a core for the loop inductor 74. The presence of the vehicle/core 82 increases the inductance of the loop 74.

Each end 90 and 88 of the inductive loop 74 is connected to a sensing circuit that, in this case, controls a traffic light 78. The change in inductance may be sensed in a number of ways. One method is to make the loop 74 part of an oscillator circuit where the frequency of oscillation varies depending on the inductance of the loop 74. In this case, the oscillator will have a first frequency when the loop is vacant and a second frequency when the loop contains a vehicle. The sensing circuit detects the frequency change to conclude if a vehicle 82 is present and to further effect the operation of the traffic light 78.

Figure 7C:
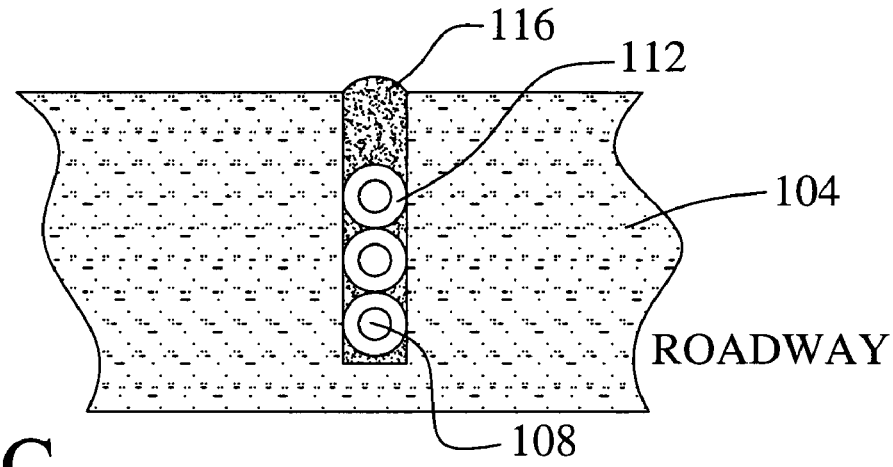
Figure 7D:
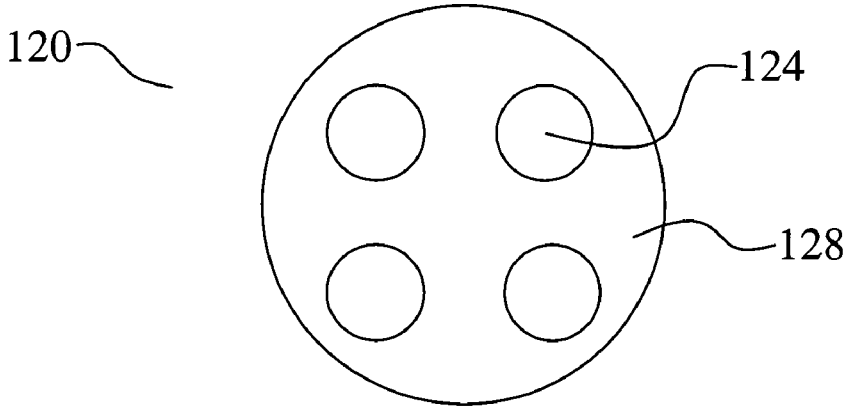
Figure 7E:
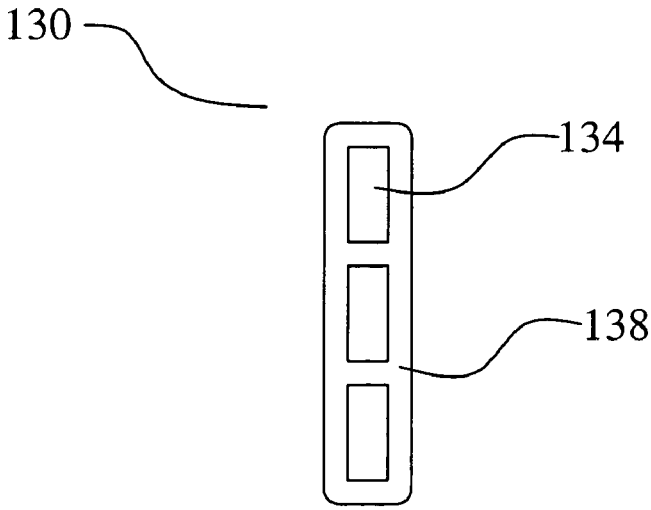

The inductive loop of conductive loaded resin-based material 74 of FIGS. 7*a* and 7*b* may be formed in several ways according to the present invention. Referring now to FIGS. 7*c* through 7*e,* several preferred embodiments of the loop 74 are illustrated. Referring particularly to FIG. 7*c,* the loop inductor comprises a conductive loaded resin-based conductor 108 encased in an insulating layer 112. In this embodiment 100, the inductive loop 74 is embedded in the vehicle roadway 104. A loop channel is first formed in the roadway by, for example, sawing. The inductor cable 108 and 112 is then routed in the channel for as many turns as are needed to establish adequate inductance. In this case, three loops are made. The conductive loaded loop conductor 108 and 112 is stacked in the channel. Once the loop detector has been routed in the sawed channel, a potting material 116 is deposited to mechanically and to environmentally isolate the inductor cable. The core conductor 108 of the inductor cable is constructed of conductive loaded resin-based material to thereby provide a permanent loop inductor that is very resistant to corrosion and/electrolysis. In a typical prior art inductive loop, the conductor comprises metal wire must be environmentally isolated with multiple layers of materials to prevent water intrusion over many years of service. The ability to form the conductive loaded resin-based conductor 108 to withstand moisture and/or corrosive environments without expensive coating and potting materials represents a distinct manufacturing advantage. The cable 108 and 112 may be formed, for example, by co-extrusion where the conductive loaded resin-based core 108 is first extruded and then a resin-based insulating layer 112 is extruded over the core conductor 108.

Referring now to FIG. 7*d,* the loop inductor 120 may be pre-formed into a multiple turn loop inductor cable 120 as shown. Multiple conductive loaded resin-based conductors 124 may be bundled into a single cable 120 and bound together with an insulating layer 128 as shown. In the illustration, a four turn inductive loop may be installed in the roadway by simply routing the pre-formed cable 120 a single time around the intended perimeter. Again, the ability to form the conductive loaded resin-based conductor 124 to withstand moisture and/or corrosive environments without expensive coating and potting materials represents a distinct manufacturing advantage. The cable 124 and 128 may be formed, for example, by co-extrusion where the conductive loaded resin-based cores 124 is first extruded. Then a resin-based insulating layer 128 is extruded over the core conductors 124. Referring now to FIG. 7*e,* an insulated 138 multiple conductor 134 cable 130 may be formed in various cross sections, such as a rectangular cross section, that can be made to easily fit into a routing channel. The conductive loaded resin-based loop inductor of the present invention may be applied to many sensing applications such as traffic control, gate and garage control, traffic monitoring, and the like.

Figure 8A:
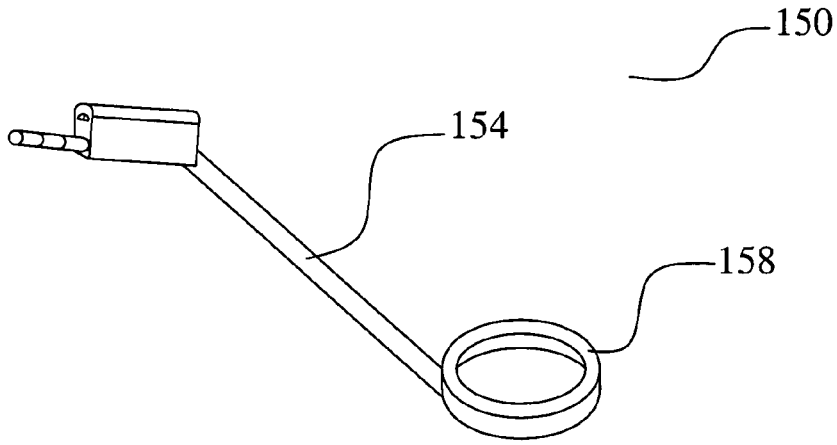
FIGS. 8*a* through 8*c* illustrate a fifth preferred embodiment of the present invention illustrating a magnetic field generator in a metal detector device.
Figure 8B:
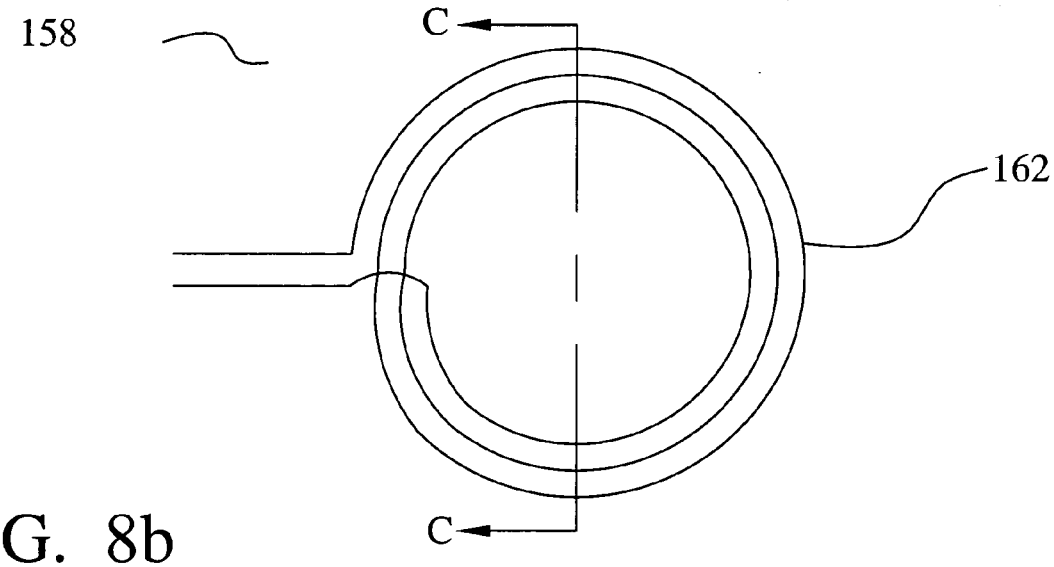
Figure 8C:
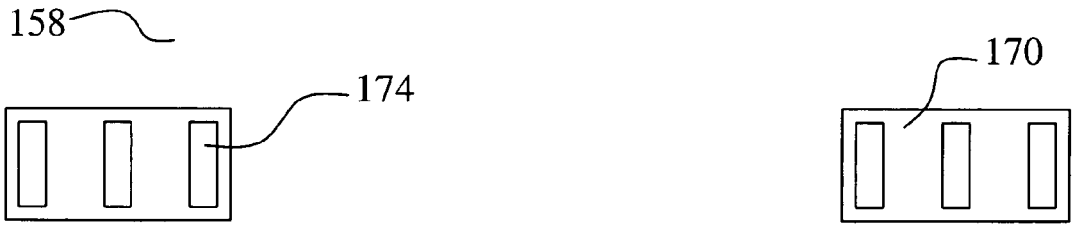

Referring now to FIGS. 8*a* through 8*c*, a fifth preferred embodiment of the present invention is illustrated. Inductive loops 158 for metal detector devices 150 are formed of the conductive loaded resin-based material according the present invention. Portable metal detectors 150 are used by recreational treasure seekers as well as by law enforcement personal to locate metal objects in the field. Other types of metal detectors are used for public safety, security, and human screening at airports and at other public buildings. Still other metal detectors are used for insuring food safety in food processing plants. Most metal detectors have an inductive loop that is capable of generating a time-varying magnetic field. This magnetic field propagates a small distance out from the loop. If the magnetic field interacts with metal objects, then an electrical current will be generated in the metal object in response to the changing magnetic field. In turn, this induced current will generate yet a further magnetic field propagating out from the metallic object. The presence of this secondary magnetic field can be sensed in several ways. For example, a second, sensing inductive loop on the metal detecting apparatus can be constructed to be shielded from the primary field and yet sensitive to the secondary field. The secondary (object) field will induce current on the sensing loop that can be detected. Alternatively, magnetic energy returning from the primary loop can be analyzed to determine the presence of a secondary source (the metal object) of magnetic energy.

The magnetic loop generator 158 of the metal detector 150 comprises multiple winds of conductive loaded resin-based lines 162 of the present invention. This type magnetic loop generator is used on portable detectors as well as fixed detectors such as in airport screening. The ability to mold the loop conductors 174 of conductive loaded resin-based material provides several advantages as discussed above. A single molding step may be used to mold the conductors 174. A secondary over-molding or spraying/dipping/coating step may then be used to form an insulating layer 170 over the conductive lines 174 as needed. This method of forming a loop magnetic generator 158 eliminates the need for a metal wire winding apparatus in the manufacturing process. Further, the loop 158 may be integrated into other conductive circuits or shields that are simultaneously molded of the conductive loaded resin-based material. For example, a shielding structure, not shown, of conductive loaded resin-based material may be simultaneously formed with the inductive loop lines 162.

Figure 2:
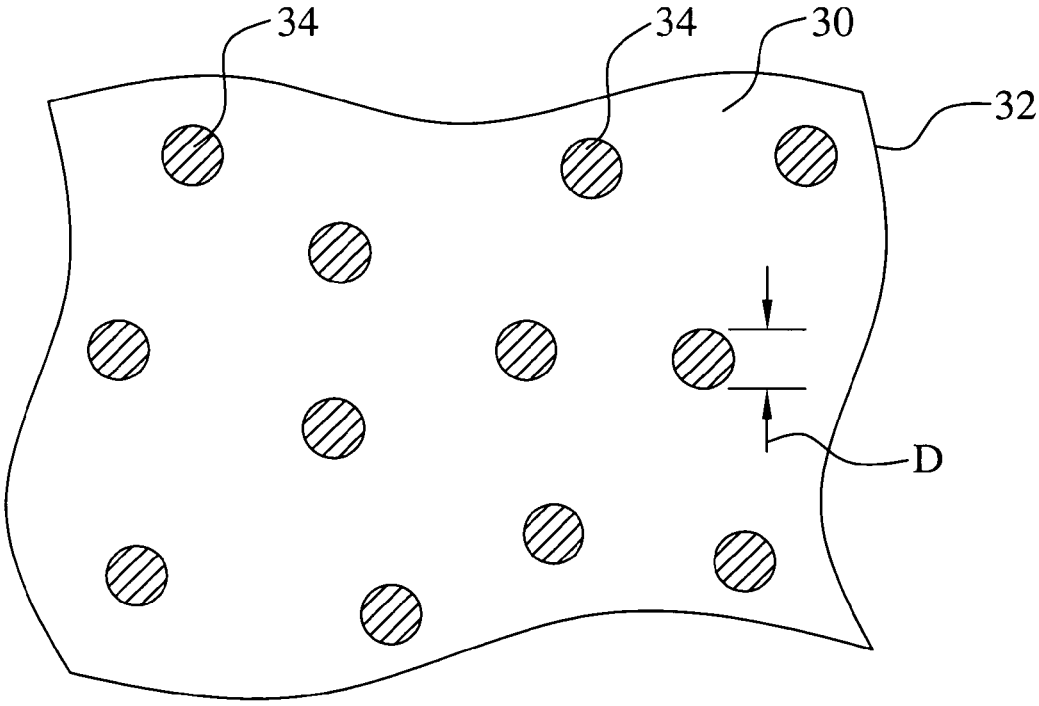
FIG. 2 illustrates a first preferred embodiment of a conductive loaded resin-based material wherein the conductive materials comprise a powder.

The conductive loaded resin-based material typically comprises a micron powder(s) of conductor particles and/or in combination of micron fiber(s) homogenized within a base resin host. FIG. 2 shows cross section view of an example of conductor loaded resin-based material 32 having powder of conductor particles 34 in a base resin host 30. In this example the diameter D of the conductor particles 34 in the powder is between about 3 and 12 microns.

Figure 3:
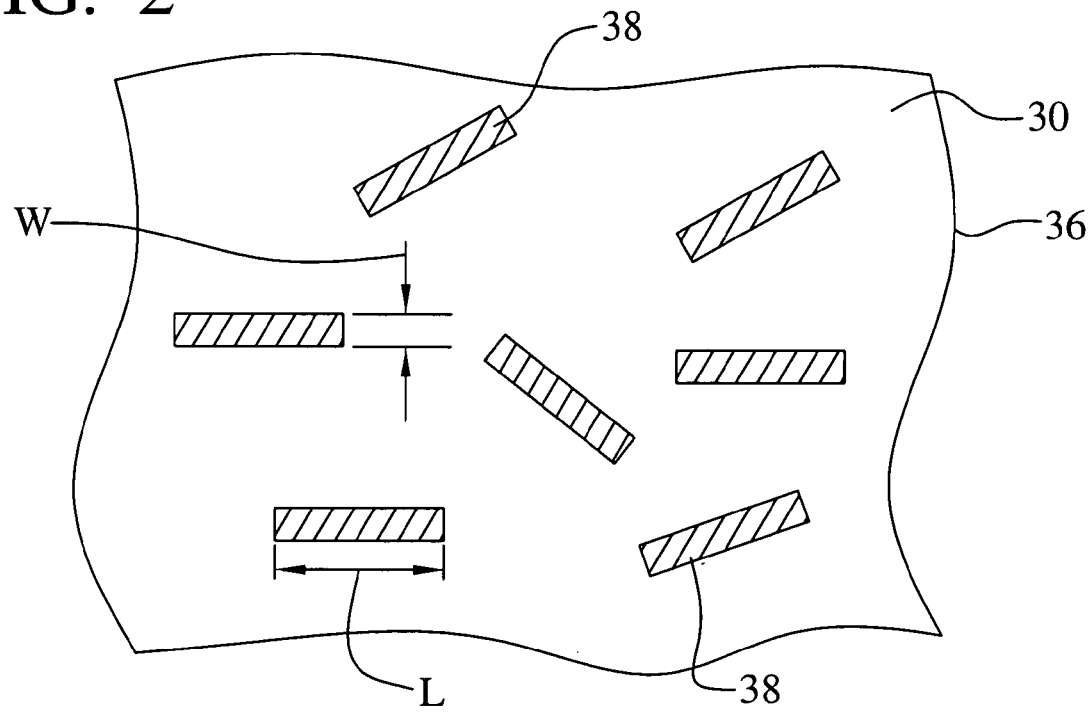
FIG. 3 illustrates a second preferred embodiment of a conductive loaded resin-based material wherein the conductive materials comprise micron conductive fibers.
Figure 4:
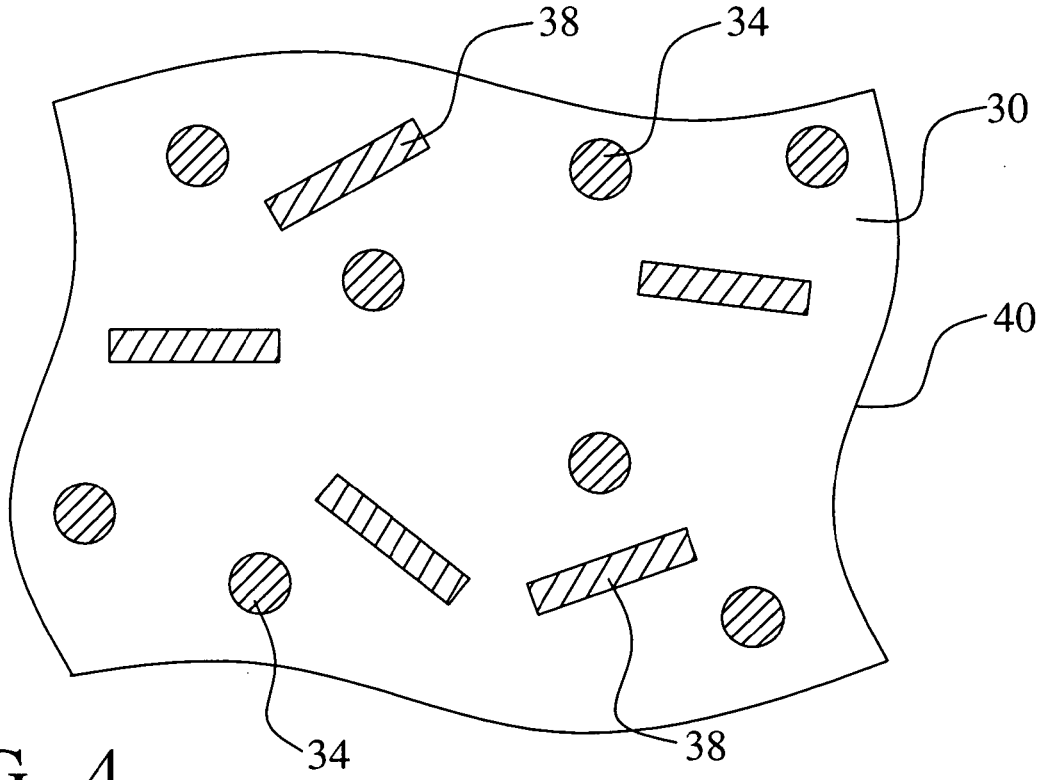
FIG. 4 illustrates a third preferred embodiment of a conductive loaded resin-based material wherein the conductive materials comprise both conductive powder and micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The conductors used for these conductor particles 34 or conductor fibers 38 can be stainless steel, nickel, copper, silver, or other suitable metals or conductive fibers, or combinations thereof. These conductor particles and or fibers are homogenized within a base resin. As previously mentioned, the conductive loaded resin-based materials have a resistivity between about 5 and 25 ohms per square, other resistivities can be achieved by varying the doping parameters and/or resin selection. To realize this resistivity the ratio of the weight of the conductor material, in this example the conductor particles 34 or conductor fibers 38, to the weight of the base resin host 30 is between about 0.20 and 0.40, and is preferably about 0.30. Stainless Steel Fiber of 8–11 micron in diameter and lengths of 4–6 mm with a fiber weight to base resin weight ratio of 0.30 will produce a very highly conductive parameter, efficient within any EMF spectrum. Referring now to FIG. 4, another preferred embodiment of the present invention is illustrated where the conductive materials comprise a combination of both conductive powders 34 and micron conductive fibers 38 homogenized together within the resin base 30 during a molding process.

Figure 5A:
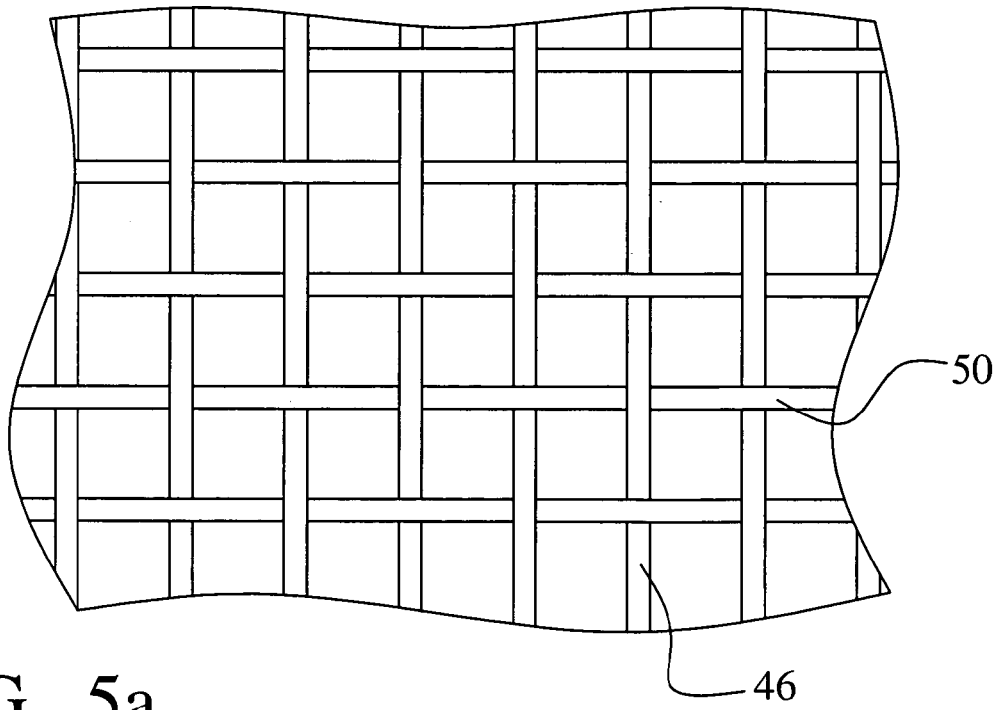
FIGS. 5*a* and 5*b* illustrate a fourth preferred embodiment wherein conductive fabric-like materials are formed from the conductive loaded resin-based material.
Figure 5B:
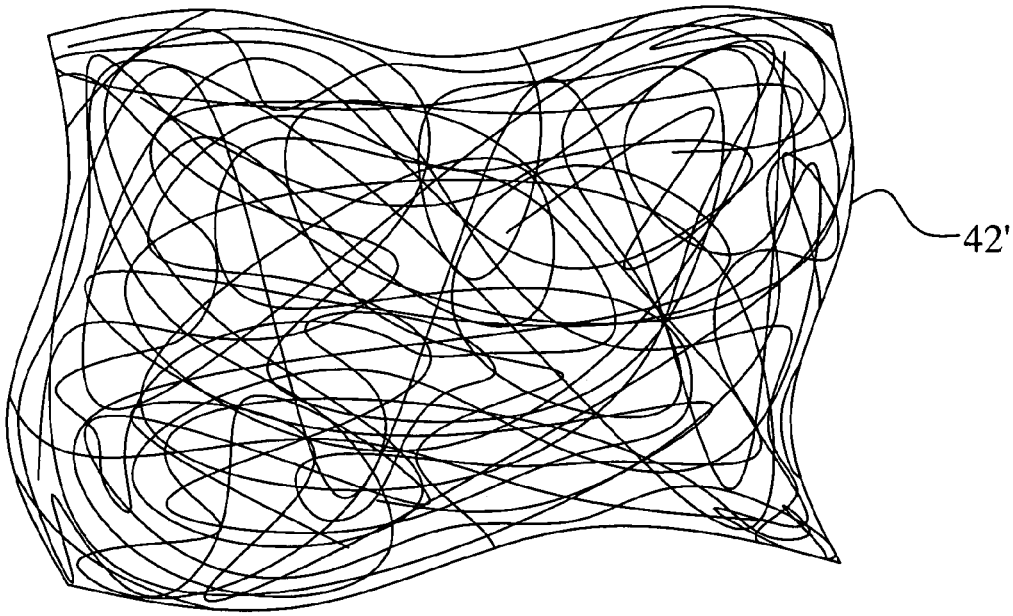

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
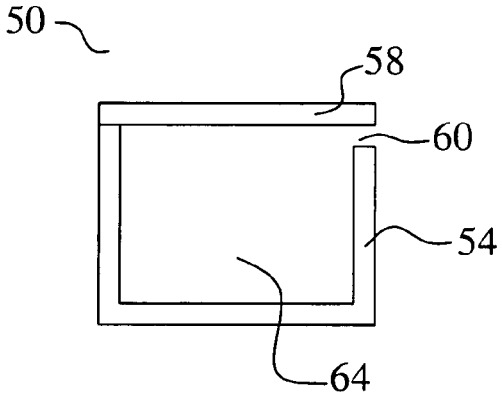
FIGS. 6*a* and 6*b* illustrate, in simplified schematic form, an injection molding apparatus and an extrusion molding apparatus that may be used to mold inductors and inductive devices of a conductive loaded resin-based material.

Inductors and inductive devices formed from conductive loaded resin-based materials can be formed or molded in a number of different ways including injection molding, extrusion or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the homogenized conductive material cures by thermal reaction. The upper portion 58 and lower portion 54 of the mold are then separated or parted and the inductor devices are removed.

Figure 6B:
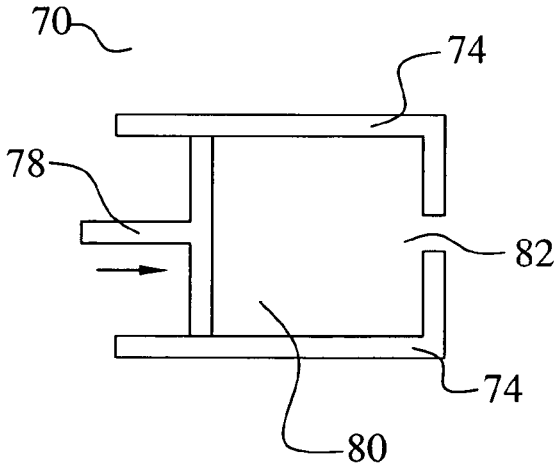

FIG. 6*b* shows a simplified schematic diagram of an extruder 70 for forming inductors and inductive devices using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use.

The advantages of the present invention may now be summarized. An effective inductor device is achieved. A method to form an inductor device is achieved. The inductor devices are molded of conductive loaded resin-based materials. Methods to fabricate an inductor device from a conductive loaded resin-based material incorporate various forms of the material. An improved inductor device is created by improving the characteristics of the core material. An improved inductor device is created improving the characteristics of the wiring material.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. An inductor device comprising a loop of conductive loaded, resin-based material comprising materials in a base resin host; wherein said loop further comprises a core structure located inside said loop, wherein said core structure alters the inductance of said loop.

2. The device according to claim 1 wherein the ratio, by weight, of said conductive materials to said resin host is between about 0.20 and about 0.40.

3. The device according to claim 1 wherein said conductive materials comprise metal powder.

4. The device according to claim 3 wherein said metal powder is nickel, copper, or silver.

5. The device according to claim 3 wherein said metal powder is metal plated.

6. The device according to claim 5 wherein said metal plating is nickel, copper, silver, or alloys thereof.

7. The device according to claim 3 wherein said metal powder comprises a diameter of between about 3 □m and about 12 □m.

8. The device according to claim 1 wherein said conductive materials comprise non-metal powder.

9. The device according to claim 8 wherein said non-metal powder is carbon, graphite, or an amine-based material.

10. The device according to claim 1 wherein said conductive materials comprise a combination of metal powder and non-metal powder.

11. The device according to claim 1 wherein said conductive materials comprise micron conductive fiber.

12. The device according to claim 11 wherein said micron conductive fiber is nickel plated carbon fiber, stainless steel fiber, copper fiber, silver fiber or combinations thereof.

13. The device according to claim 11 wherein said micron conductive fiber has a diameter of between about 3 □m and about 12 □m and a length of between about 2 mm and about 14 mm.

14. The device according to claim 1 wherein said conductive materials comprise a combination of conductive powder and conductive fiber.

15. The device according to claim 1 further comprising an electrically insulating layer surrounding said loop.

16. The device according to claim 15 wherein said electrically insulating layer is a resin-based material.

17. The device according to claim 15 wherein said loop and said electrically insulating layer are flexible.

18. The device according to claim 1 wherein said core structure is a vehicle.

19. The device according to claim 1 wherein said core structure comprises said conductive loaded resin-based material.

20. The device according to claim 19 wherein said conductive loaded resin-based material comprises an iron-based conductive load.

21. The device according to claim 1 wherein said core structure comprises a metal.

22. The device according to claim 1 wherein said loop comprises multiple turns of said conductive loaded resin-based material.

23. The device according to claim 1 further comprising:

a second loop of said conductive loaded resin-based material; and a core structure located inside said loop and inside said second loop wherein said core structure inductively couples said loops.

24. The device according to claim 23 wherein said loop and said second loop each comprises multiple turns of said conductive loaded resin-based material.

25. The device according to claim 1 wherein said loop is used to generate a magnetic field.

26. The device according to claim 1 wherein said loop is used to detect a magnetic field.

27. An inductor device comprising a conductive loop, wherein the conductive loop comprises said conductive loaded resin-based material; and a core structure located inside the loop wherein the core structure comprises conductive loaded, resin-based material comprising conductive materials in a base resin host.

28. The device according to claim 27 wherein the ratio, by weight, of said conductive materials to said resin host is between about 0.20 and about 0.40.

29. The device according to claim 27 wherein said conductive materials comprise metal powder.

30. The device according to claim 29 wherein said metal powder is metal plated.

31. The device according to claim 27 wherein said conductive materials comprise non-metal powder.

32. The device according to claim 27 wherein said conductive materials comprise a combination of metal powder and non-metal powder.

33. The device according to claim 27 wherein said conductive materials comprise micron conductive fiber.

34. The device according to claim 27 wherein said conductive materials comprise a combination of conductive powder and conductive fiber.

35. The device according to claim 27 further comprising an electrically insulating layer surrounding said core structure.

36. The device according to claim 35 wherein said electrically insulating layer is a resin-based material.

37. The device according to claim 27 wherein said loop comprises multiple turns.

38. The device according to claim 27 further comprising a second loop wherein said core structure is inside of said second loop and wherein said core structure inductively couples said loops.

39. The device according to claim 38 wherein said loop and said second loop each comprises multiple turns of said conductive loaded resin-based material.

40. The device according to claim 27 wherein said loop is used to generate a magnetic field.

41. The device according to claim 27 wherein said loop is used to detect a magnetic field.

42. A method to form an inductor device, said the method comprising: providing a conductive loaded, resin-based material comprising conductive materials in a resin-based host; and molding said conductive loaded, resin-based material into a loop to form an inductor device; wherein said molded conductive loaded resin-based device comprises a core.

43. The method according to claim 42 wherein the ratio, by weight, of said conductive materials to said resin host is between about 0.20 and about 0.40.

44. The method according to claim 42 wherein the conductive materials comprise a conductive powder.

45. The method according to claim 42 wherein said conductive materials comprise a micron conductive fiber.

46. The method according to claim 42 wherein said conductive materials comprise a combination of conductive powder and conductive fiber.

47. The method according to claim 42 wherein said molding comprises:

injecting said conductive loaded, resin-based material into a mold;

curing said conductive loaded, resin-based material; and removing said inductor device from said mold.

48. The method according to claim 47 further comprising forming an electrically insulating layer over said inductor device.

49. The method according to claim 48 wherein said step of forming an electrically insulating layer comprises overmolding.

50. The method according to claim 48 wherein said step of forming an electrically insulating layer comprises dipping, spraying, or coating.

51. The method according to claim 42 wherein said molding comprises:

loading said conductive loaded, resin-based material into a hopper;

extruding said conductive loaded, resin-based material out of said hopper through a shaping outlet; and curing said conductive loaded, resin-based material to form said inductor device.

52. The method according to claim 51 further comprising stamping or milling said molded conductive loaded, resin-based material.

53. The method according to claim 51 further comprising forming an electrically insulating layer over said inductor device.

54. The method according to claim 53 wherein said step of forming an electrically insulating layer comprises extrusion.

55. The method according to claim 53 wherein said step of forming an electrically insulating layer comprises dipping, spraying, or coating.

* * * * *